US005884610A

United States Patent [19]

Reddy

[11] Patent Number: 5,884,610

[45] Date of Patent: Mar. 23, 1999

[54] FUEL REID VAPOR PRESSURE ESTIMATION

[75] Inventor: Sam Raghuma Reddy, West Bloomfield, Mich.

[73] Assignee: General Motors Corporation, Detroit, Mich.

[21] Appl. No.: 948,501

[22] Filed: Oct. 10, 1997

[51] Int. Cl.[6] ..... F02M 33/04

[52] U.S. Cl. ..... 123/520; 73/119 A; 123/698

[58] Field of Search ..... 123/516, 518, 123/519, 520, 689, 698; 73/117.3, 119 A

[56] References Cited

U.S. PATENT DOCUMENTS

| | | | |
|---|---|---|---|
| 4,748,959 | 6/1988 | Cook et al. . | |
| 5,275,144 | 1/1994 | Gross | 123/518 |
| 5,327,872 | 7/1994 | Morikawa | 123/516 |
| 5,343,760 | 9/1994 | Sultan et al. . | |
| 5,351,193 | 9/1994 | Poirier et al. . | |
| 5,596,972 | 1/1997 | Sultan et al. . | |
| 5,637,788 | 6/1997 | Remboski et al. | 73/40.5 R |
| 5,727,537 | 3/1998 | Nakagawa et al. | 123/698 |
| 5,746,187 | 5/1998 | Ninomiya et al. | 123/698 |
| 5,765,541 | 6/1998 | Farmer et al. | 123/698 |

*Primary Examiner*—Thomas N. Moulis
*Attorney, Agent, or Firm*—Michael J. Bridges

[57] ABSTRACT

Automotive internal combustion engine control and diagnostics responsive to an up-to-date on-board estimate of fuel reid vapor pressure (RVP). An on-board fuel vapor recovery system traps fuel vapors released from a fueling system and is controlled to release the vapors to the engine for consumption therein, along with an injected fuel charge under closed-loop engine air/fuel ratio control. The change in the injected fuel charge required to maintain, under closed-loop control conditions, a target air/fuel ratio in the presence and in the absence of the released fuel vapors is applied along with fuel temperature information to estimate RVP, and the RVP estimate is applied under coldstart operating conditions to adjust engine fueling to account for corresponding changes in the vaporization characteristic of the fuel and is applied, when determined to be relatively high, to indicate potential false positives in fuel vapor recovery system diagnostics.

12 Claims, 4 Drawing Sheets

FUEL REID VAPOR PRESSURE ESTIMATION

TECHNICAL FIELD

This invention relates to automotive control and diagnostics and, more particularly, to internal combustion engine control and diagnostics responsive to fuel RVP estimation.

BACKGROUND OF THE INVENTION

Gasoline reid vapor pressure (RVP), the vapor pressure of gasoline measured at 100° Fahrenheit under specified measurement procedures, is generally recognized as a measure of fuel volatility. High gasoline RVP improves engine startability and driveability at low ambient temperature, but can have a negative effect on the precision of certain fueling system diagnostics. RVP can vary significantly between available fuels. It would be desirable, for a given fuel, to determine its RVP and to adjust fueling system control and diagnostics in response to the determined RVP for improved performance and for increased diagnostic integrity.

Conventional RVP measurement is conducted through analysis of a sample of fuel under laboratory conditions. The measurement results are not currently applied in control and diagnostics procedures on-board automotive vehicles. On-board re-fueling vapor recovery (ORVR) systems (also referred to herein as fuel vapor recovery systems) have been proposed for application on-board automotive vehicles. ORVR systems include a canister with fuel vapor adsorbing material through which re-fueling vapors are passed and in which such vapors are trapped during re-fueling procedures for controlling evaporative fuel vapor emissions. The trapped ORVR vapors are, from time to time during engine operation, purged from the adsorbing material for consumption in the engine. The rate of purge of the ORVR vapors has been determined to vary with fuel RVP. It would be therefore be desirable to estimate RVP using such purge rate information from ORVR systems.

SUMMARY OF THE INVENTION

The present invention provides for accurate on-board RVP estimation using information available through the proposed ORVR systems and for fuel system control and diagnostics responsive to the estimation. More specifically, the mass flow rate of fuel vapor purged from the canister of an ORVR system to an engine is determined and fuel temperature is estimated or measured. Fuel RVP is generated as a function of the mass flow rate of the purged fuel vapor and the fuel temperature, and is applied in engine control and diagnostic procedures.

In accord with an aspect of this invention, the mass flow rate of the fuel vapor from the canister of the ORVR system to the engine is determined as a function of the response of a closed-loop air/fuel ratio control system to a known change in state of the ORVR system. The known change in state is a change from an inactive state to a predetermined active state in accord with a further aspect of this invention. The response of the closed-loop air-fuel ratio control system is taken as the degree of change in magnitude of a closed-loop fueling command in accord with a further aspect of this invention. The change in the closed-loop fueling command is the change in a closed-loop integrator applied to an open-loop fueling command to drive a measured air/fuel ratio toward a desired air/fuel ratio in accord with yet a further aspect of this invention.

The RVP estimate is applied to correct open-loop fueling, such as following an engine cold start, to account for change in fuel vaporization characteristic with change in fuel RVP. Further, the RVP estimate is applied to clarify when ORVR system diagnostics may be operating with reduced accuracy, such as under relatively high fuel RVP.

BRIEF DESCRIPTION OF THE DRAWINGS

The invention may be best understood by reference to the preferred embodiment and to the drawings in which.

DESCRIPTION OF THE PREFERRED EMBODIMENT

Figure 1:
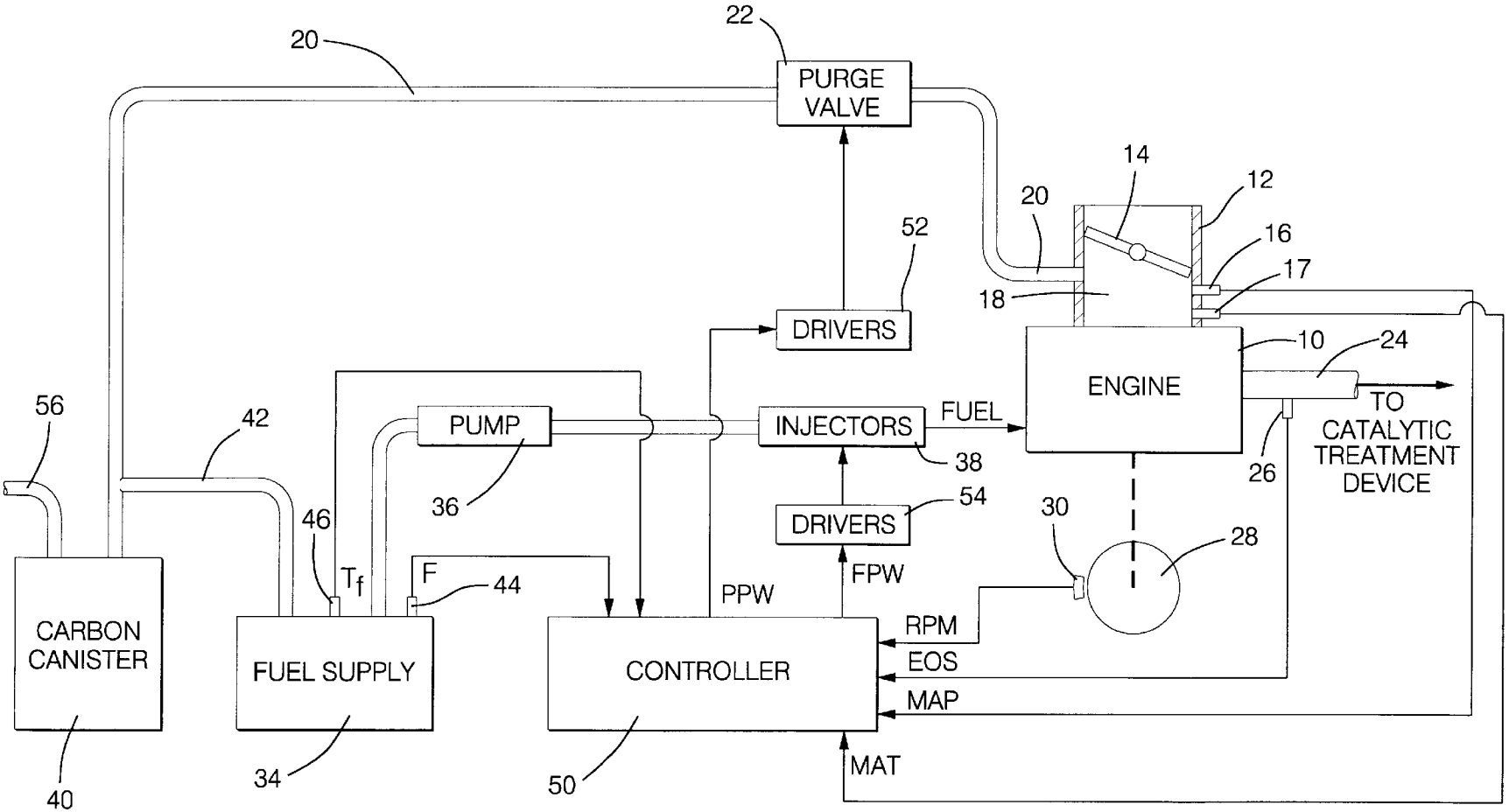
FIG. 1 is a general diagram of an engine including ORVR system hardware for carrying out the preferred embodiment of this invention.

Referring to FIG. 1, internal combustion engine 10 receives intake air through intake air bore 12 in which is disposed intake air valve 14, such as a conventional throttle valve for restricting passage of intake air through the intake air bore 12 to intake manifold 18 downstream of intake air valve. Intake manifold absolute air pressure is transduced by conventional pressure transducer 16 into output signal MAP. Engine fuel pump 36 draws fuel from fuel supply 34 taking the form of a conventional fuel tank and provides pressurized fuel to at least one conventional fuel injector 38 which is electronically controlled to meter fuel to engine cylinder intake passages (not shown).

Fuel vapor evaporating from the fuel supply 34 and fuel vapor that is displaced during re-fueling operations are trapped for recovery in an on-board re-fueling vapor recovery (ORVR) system as is known to be proposed for vapor recovery management. The ORVR system, also referred to herein as a fuel vapor recovery system, functions in the following manner. The fuel vapor is guided through vapor conduit 42 which opens into a canister 40 in which is disposed a volume of activated carbon having a well-recognized fuel vapor adsorbing capacity. The fuel vapor is adsorbed on the activated carbon of the canister 40. Purge conduit 20 is provided between intake manifold 18 and the canister 40. Vent conduit 56 open into the canister 40 on a first end, with a second end opposing the first end exposed to ambient air. The vent conduit may include a normally open vent valve that may be selectively driven to a closed position in accordance with conventional diagnostic or maintenance procedures. Purge valve 22, such as a conventional electronically controlled solenoid valve, is disposed in the purge conduit 20. When the valve 22 is electrically driven to an open position, the canister 40 is exposed to intake manifold vacuum of a running engine 10, drawing ambient air through the vent conduit 56 to the canister 40, across the activated carbon thereof for drawing fuel vapor with the ambient air from the canister 40 and through the conduit 20 into intake manifold 18 for mixing with intake air and distribution via the manifold 18 to engine cylinder intake passages (not shown) where the mixture of intake air and purged vapor is further combined with injected fuel for admission to engine cylinders (not shown) for timed combustion therein.

The inventor intends that any precision vapor control valve mechanization may be provided in conduit 20 for controlling the passage of purge vapor to the engine intake manifold 18, including linear precision solenoid valves or sonic flow solenoid valves. A mass airflow sensor (not shown) of a conventional design, such as a commercially-available thick film or hot wire type mass airflow sensor, may be provided in intake air bore 12 for transducing the mass of intake air passing thereby into an output signal. The mixture of injected fuel, purged vapor and intake air is admitted to engine cylinders for combustion therein, for rotating at least one engine output shaft, such as crankshaft 28, having a series of teeth or notches circumferentially disposed about the shaft. A conventional Hall Effect, magnetoresistive, or variable reluctance sensor 30 is positioned so the teeth or notches of the crankshaft 28 pass the sensor as the shaft rotates with sufficient proximity to the sensor to measurably disrupt the sensor magnetic field. The disruptions may be transduced into sensor output signal variations provided as analog signal RPM, which indicates the rate of rotation and relative angular orientation of the crankshaft 28. The frequency of signal RPM is proportional to the rate of rotation of the crankshaft (which is also referred to herein as engine speed). For an N cylinder, four stroke engine, an engine cylinder event will be detected from the signal RPM for every 720/N degrees of crankshaft rotation, and a cylinder event interrupt will be generated indicating the cylinder event which takes the form of a cylinder top dead center event in this embodiment.

The engine cylinder combustion products are exhausted out of engine 10 and through exhaust gas conduit 24 in which is disposed at least one zirconia oxide sensor 26 taking the form of a conventional wide-range oxygen sensor for transducing oxygen content of the exhaust gas into output signal EOS. Temperature transducer 46, such as a conventional thermistor or thermocouple is provided in the fuel supply 34 for transducing the temperature of the gasses therein into output signal $T_f$. Fuel level sensor 44 is disposed in the fuel supply and takes any suitable conventional form for transducing the volume of fuel in the supply 34 into output signal F. Temperature sensor 17 in the form of a conventional thermistor or thermocouple is disposed within the intake manifold 18 for transducing air temperature therein into output signal MAT.

Controller 50, such as a conventional sixteen bit microcontroller of a suitable, commercially-available design is provided including such generally known elements (not shown) as a central processing unit, read only memory devices for long term data storage, random access memory devices for rapid, temporary data storage including non-volatile devices, and input/output devices for interfacing with external devices, such as for receiving signals $T_f$, RPM, EOS, F, MAT, and MAP and for periodically converting the signals to a digital equivalent, and for periodically outputting control signals, such as signals FPW and PPW to respective driver circuitry.

More specifically, the controller 50, through periodic step-by-step execution of a series of control operations taking the form of a sequence of software instructions in this embodiment, samples and processes certain of the above-described input signals and generates fuel pulse width control signal FPW in the form of a fixed amplitude pulse width modulated command applied to conventional fuel injector driver circuitry 54 for timed application to selected fuel injectors 38 for opening the injectors to allow pressurized fuel to pass therethrough for the duration of the pulse-width of the signal FPW. At certain times during an operating cycle of the engine 10, and when certain operating conditions are present, fuel vapor is purged from the canister 40 by driving the purge valve 22 to an open orientation. For example, the controller 50, through periodic step-by-step execution of a series of control operations taking the form of a sequence of software instructions in this embodiment, samples and processes certain of the above-described input signals and generates purge pulse width control signal PPW in the form of a fixed amplitude pulse width modulated command applied to conventional linear solenoid valve driver circuitry 52 for application to the purge valve 22 to drive the valve to a degree of opening consistent with a desired purge schedule, such as may be stored in read only memory and referenced as a function of current operating conditions.

Figure 2:
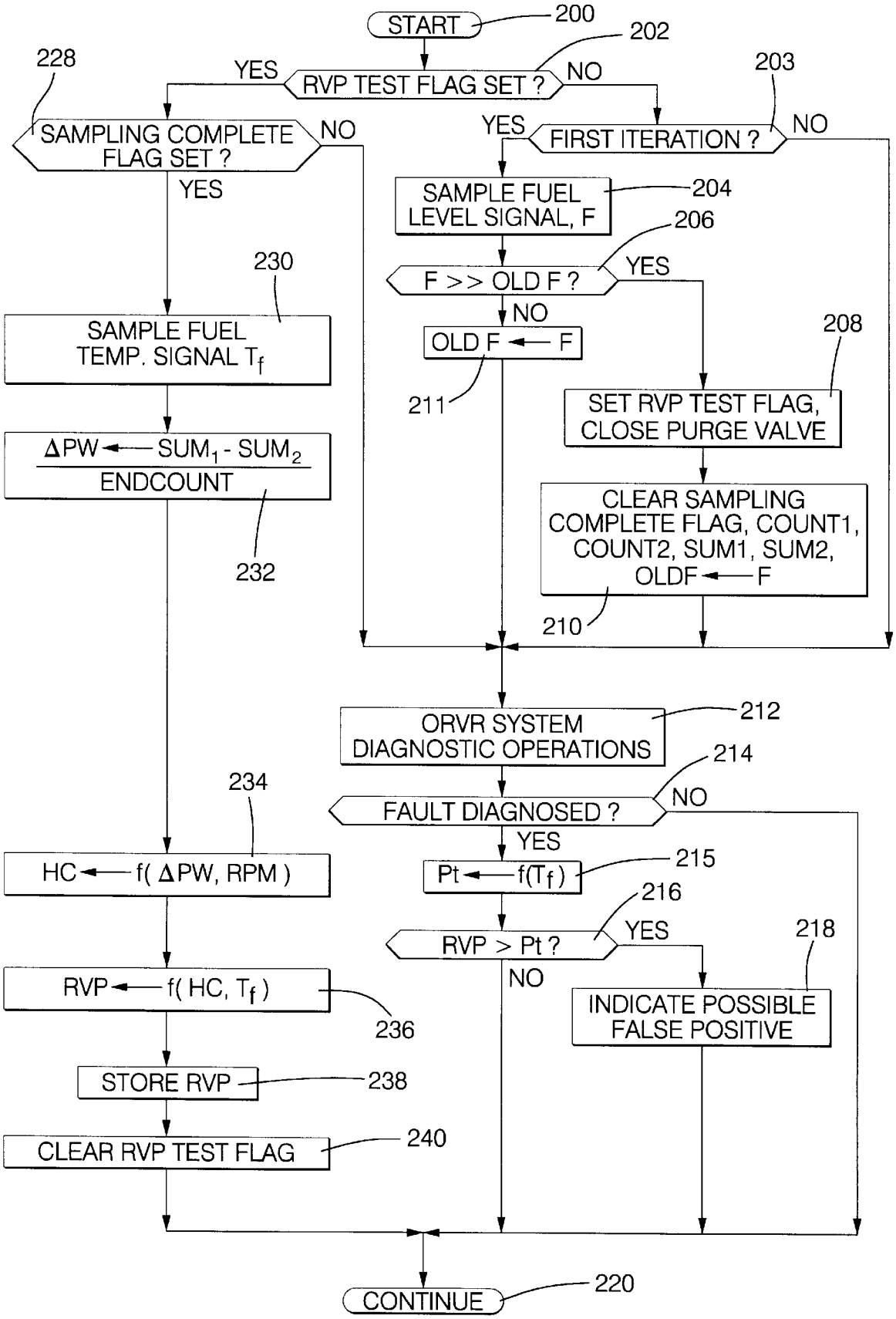
FIGS. 2 and 3 are computer flow diagrams illustrating a flow of operations for carrying out the preferred embodiment of this invention with the hardware of FIG. 1.
Figure 3:
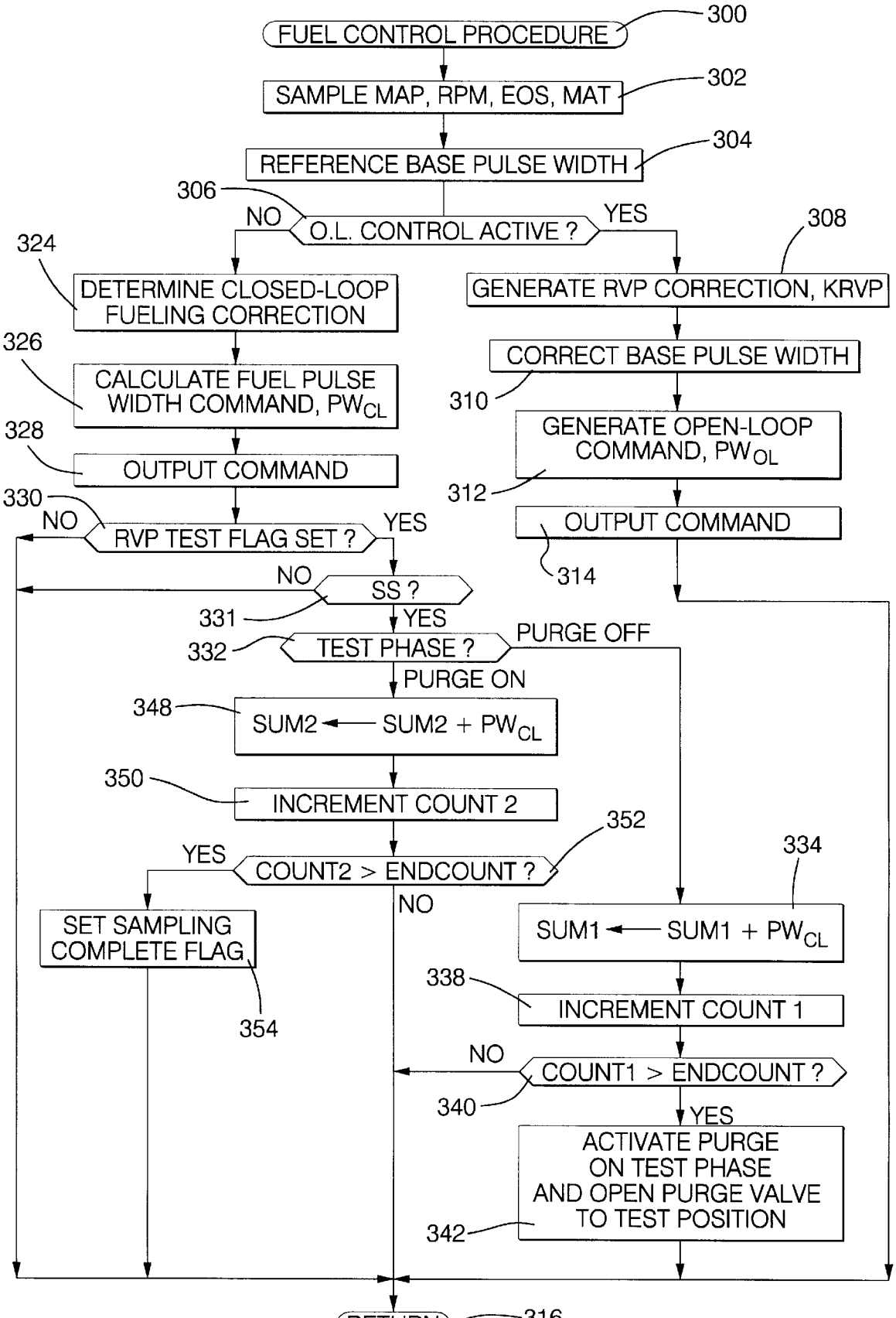

The sequence of operations for carrying out such control are illustrated in a step-by-step manner in FIGS. 2 and 3 which are implemented in this embodiment as a corresponding sequence of software instructions as may be generated through the exercise of standard software design procedures. The operations are periodically carried out throughout each cycle of automotive vehicle operation. For example, the operations of FIG. 2 are carried out on a predetermined timing, such as approximately every ten milliseconds while the controller 50 is active. The controller 50 is active while a vehicle operator manually maintains vehicle ignition power in an "ON" state. The operations of FIG. 3 are executed upon each occurrence of an engine cylinder event, such as for each cylinder top dead center event of each cylinder (not shown) of the engine 10 of FIG. 1.

Generally, the operations of FIG. 2 establish the conditions under which fuel RVP in the fuel supply (fuel tank) 34 (FIG. 1) is measured in accordance with this invention, and carry out ORVR system diagnostic operations, wherein the ORVR system includes such elements of FIG. 1 as the canister 40, conduits 20, 42, and 56, purge valve 22 and driver 52, and transducer 46.

Such operations are initiated in any conventional manner by controller 50, for example upon each occurrence of a timer-based interrupt set up to occur each ten milliseconds while the controller 50 is active. Upon initiation of the operations of FIG. 2 at a step 200, the operations proceed to read the current status of an RVP test flag stored in random access memory at a next step 202. If such flag is set, a procedure to determine the fuel RVP is currently being carried out, and the procedure is continued by proceeding to read a sampling complete flag at a step 228. If the sampling complete flag is set, a sufficient number of fuel control samples (to be described) have been accumulated to ensure an accurate estimate of fuel RVP, and the analysis procedure continues by calculating a change in fuel control pulse width ΔPW as follows $$\Delta PW = \frac{\mathrm{SUM}_1 - \mathrm{SUM}_2}{\mathrm{ENDCOUNT}}$$

in which $\mathrm{SUM}_2$ is a sum of ENDCOUNT samples of fueling commands under test conditions with the purge valve 22 in an open position, and $\mathrm{SUM}_1$, is a sum of ENDCOUNT samples of fueling commands under the test conditions with the purge valve in a closed (restricted) position. ΔPW represents the change in fueling required to offset a known change in fuel vapor purge state, and indicates, for a given desired engine air/fuel ratio and a responsive closed-loop air/fuel ratio control function with a substantially stable inlet air rate, the amount of fuel vapor purged from the canister 40 (FIG. 1), as is applied in a determination of fuel RVP.

After determining ΔPW at the step 232, hydrocarbon flow rate HC from the canister 40 (FIG. 1) to the engine 10 is determined as a function of ΔPW and engine speed as indicated by signal RPM, which may have first been applied to conventional filtering and processing stages as is generally understood in the art. The functional relationship between HC and ΔPW and RPM is determined in this embodiment through a conventional calibration procedure for the specific hardware of this embodiment, such as the hardware described in FIG. 1. The relationship is then implemented as a function stored in non-volatile memory (not shown) of the controller 50 of FIG. 1 or, alternatively, as a standard lookup table in such memory. More specifically, HC is determined in this embodiment as follows:

HC=k*RPM*ΔPW in which k is a calibrated gain, and HC is expressed in units of grams per ten liters of purge vapor in this embodiment.

Returning to FIG. 2, after determining HC at the step 234, a fuel RVP value representing fuel volatility is determined as a function of HC and $T_f$ at a next step 236, for example as follows:

$$RVP = 1.73 + 4.13 * HC + 4.45 \times 10^{-4} * T_f^2 - 3.05 \times 10^{-5} * T_f^3 - .1051 * HC * T_f + 1.378 * 10^{-3} * HC * T_f^2 - 6.471 \times 10^{-5} * HC^2 * T_f^2 + 1.71 \times 10^{-4} * HC^3 * T_f + 4.24 \times 10^{-9} * HC^3 * T_f^3;$$

in which RVP is expressed in units of p.s.i. RVP is then stored in a random access memory device of the controller 50 of FIG. 1 for use in engine control and diagnostic operations at a next step 238. The RVP test flag is next cleared at a step 240 to conclude the current analysis procedures and the routine of FIG. 2 then continues, via a next step 220, to carry out any further operations required under any conventional control, diagnostic, or maintenance procedures that are applied in this embodiment through the exercise of ordinary skill in the art to which this invention pertains.

Figure 4:
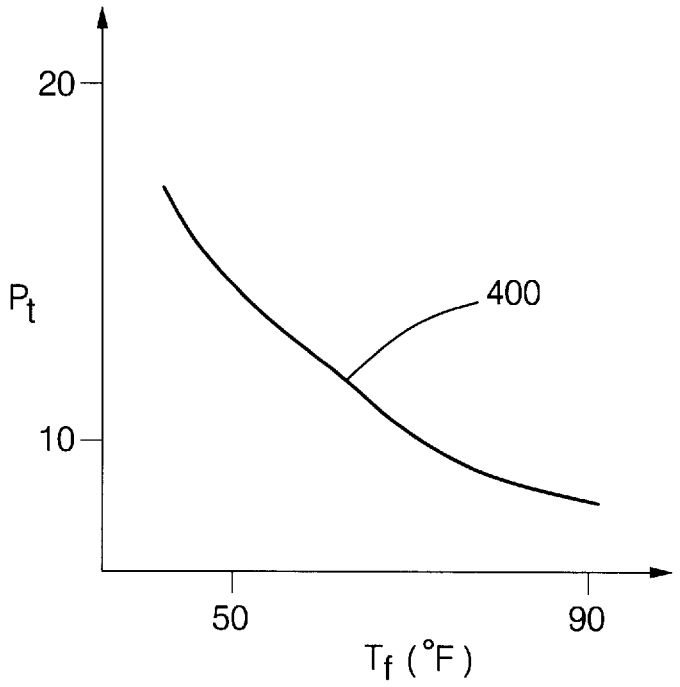
FIG. 4 is a general diagram of a relationship between a pressure threshold and fuel temperature referenced through the operations of FIG. 2.

Returning to step 228, if the sampling complete flag is determined to not be set, further sampling of fueling information is required under the currently active analysis procedures, and the described steps 230–240 are bypassed by proceeding to carry out ORVR system diagnostic operations including conventional operations to diagnose leak or restriction conditions or other generally understood performance deterioration conditions in the components of the ORVR system including the passages 20 and 42, the canister 40 and the purge valve 22 and its drivers 52 of FIG. 1. Under conditions of relatively high fuel RVP, it is proposed that the veracity of certain diagnosed fault conditions in the ORVR system of FIG. 1 may be reduced significantly. Accordingly, in the event a fault condition is diagnosed through the operations of step 212, as determined at a next step 214, a reid vapor pressure (RVP) threshold Pt is next referenced at a step 215 from a stored calibrated relationship between fuel temperature Tf within the fuel supply 34 of FIG. 1 and the threshold Pt. The threshold Pt corresponds to the fuel RVP above which the veracity of certain diagnosed ORVR system fault conditions is significantly reduced. Curve 400 of FIG. 4 generally illustrates a calibrated relationship between Tf and Pt in accordance with the present embodiment and may be implemented in the form of a conventional lookup table stored in a standard read only memory device in the controller 50 (FIG. 1) having Tf as a lookup index to retrieve a corresponding Pt value, for example through conventional interpolation procedures.

Returning to FIG. 2, the referenced threshold Pt value is next compared to RVP, as previously determined through the operations of step 236 of FIG. 2, at a step 216. If RVP exceeds Pt, the diagnosed EVAP system fault condition may be a false positive and a flag is set at a next step 218 to indicate the possible false positive. The flag may be stored along with any message or flag indicating the fault condition diagnosed at the step 212, such as in a non-volatile section of a random access memory device of the controller 50 of FIG. 1. Next, or if RVP was determined to not exceed Pt at the step 216, or if no fault condition was diagnosed as determined at the step 214, the described step 220 is carried out to continue with any further required control, diagnostic, or maintenance operations.

Returning to step 202, if the RVP flag is determined to not be set, a determination is made at a next step 203 as to whether the current iteration of the operations of FIG. 2 is the first iteration since the current engine operating cycle was manually initiated by the engine operator. If the current iteration is not the first, the described diagnostic operations of step 212 are next carried out. If the current iteration is the first, a check is required as to whether an update of fuel RVP is required, via steps 204–210. More specifically, the signal F indicating the volume of fuel in the supply 34 is first sampled at step 204 to determine current fuel level in the fuel supply 34 of FIG. 1.

The current fuel level is next compared to a most recent prior fuel level OLDF at a step 206. If F is significantly greater than OLDF, as determined at the step 206, then it is assumed a refueling operation has recently occurred, which may have led to a variation in fuel RVP. Accordingly, operations to update such fuel RVP for application in engine control and diagnostic operations are required in accordance with this invention, and are enabled by setting the RVP test flag at a next step 208, as well as by commanding the purge valve 22 of FIG. 1 to a test position, such as a fully closed position for the duration of a first test phase, to be described. Stored values used in the RVP analysis process are next initialized to zero at a next step 210, including the sampling complete flag, values COUNT1, COUNT2, SUM1, and SUM2. The value OLDF is also updated to hold the current F value at the step 210 and is stored in a non-volatile section of a random access memory device of the controller 50 of FIG. 1.

Following the step 210, the described ORVR system diagnostic operations of step 212 are carried out. Returning to step 206, if F is determined to not be significantly greater than OLDF, an update of fuel RVP information within the fuel supply 34 of FIG. 1 is assumed to not be currently required, and the value OLDF is updated with the current fuel level value indicated by F at a next step 211, wherein OLDF is stored in a non-volatile section of a random access memory device of the controller 50 of FIG. 1. Next, the described ORVR system diagnostic operations of step 212 are carried out.

Referring to FIG. 3, operations of a fuel control procedure are illustrated in a step by step manner for periodic execution while the controller 50 of FIG. 1 is active, such as following each cylinder top dead center event, for generating and issuing fuel injector drive signals and for determining a change in fuel command pulse width between two known states of the purge control system of FIG. 1, such as between an enabled and a disabled purge state. More specifically, upon occurrence of a standard event-based interrupt set up to occur following each cylinder top dead center event as is generally known to be indicated by signal RPM of FIG. 1, any ongoing controller operations are temporarily suspended and the operations of FIG. 3 are commenced at a step 300 and proceed therefrom to sample input signals MAP, MAT, RPM, and EOS at a next step 302 to indicate current intake manifold absolute air pressure, engine speed and engine air/fuel ratio, respectively. A base fuel injection pulse width is next referenced in an openloop manner at a next step 304 as a function of engine speed and engine load, with engine load representing the mass airflow rate through engine cylinders which may be determined directly through standard procedures from the speed and pressure information determined at the step 302.

If open-loop air/fuel ratio control is determined to be active at a next step 306, such as following an engine cold start operation and prior to certain components, such as the oxygen sensor 26 (FIG. 1) or the catalytic treatment device, being catalytically active, open-loop control operations are carried out at steps 308–314. Specifically, a correction value Krvp is determined at a step 308 as a predetermined function of any previously determined and stored RVP value, such as the value stored at the step 236 of FIG. 2 for the current engine operating cycle, or an RVP value stored at the step 236 during a previous engine operating cycle. The correction value Krvp accounts for fuel vaporization in the engine induction system including individual cylinder intake air and fuel runners (not shown) of the engine 10 of FIG. 1. For a period of time following an engine coldstart prior to the engine temperature elevating to an operating temperature, not all of the fuel injected to cylinder intake runners vaporizes. Some of the injected fuel condenses on the walls (not shown) of the runners or cylinders and some collects in the form of a puddle on various components in the induction system. If fuel RVP is low, less fuel vaporizes and if fuel RVP is high, more fuel vaporizes following an engine coldstart. Unvaporized fuel may pass through the engine cylinders and may not be consumed, increasing engine HC emissions. Conventional engine combustion control calibration procedures, including fuel control calibration procedures assume worst case fuel volatility corresponding to low fuel RVP, to minimize such coldstart difficulties and to minimize driveability shortcomings. Engine performance and emissions of other exhaust gas constituents are compromised under such calibrations when fuel RVP is not low. In this embodiment, the fuel RVP determined at the step 236 of FIG. 2 is provided at the step 308 of FIG. 3 to reference the correction factor Krvp to avoid such compromises. When fuel RVP is determined to be low, the correction factor is a positive value increasing engine fueling due to relatively low fuel vaporization and when fuel RVP is determined to be high, the correction factor is a negative value decreasing engine fueling due to relatively high fuel vaporization. The specific values of the correction factor Krvp may be determined, for the specific engine to which the control of this embodiment is applied, such as engine 10 of FIG. 1, through a conventional calibration procedure and stored in the form of a lookup table in a standard read only memory device of the controller 50 of FIG. 1. The correction value may be referenced from the lookup table through corresponding fuel RVP indices using standard interpolation procedures.

After determining the correction factor Krvp at the step 308, the base pulse width determined at the step 304 is next corrected at a step 310 by applying Krvp thereto as a multiplicitive or additive correction value or a combination thereof. An open-loop fueling command PWol is next determined as the amount of injector opening time required, for the specific injector 38 (FIG. 1) geometry of this embodiment, to admit an amount of fuel to a cylinder (not shown) or a cylinder intake runner (not shown) corresponding to the corrected base pulse width determined at the step 310. The command is next output as signal FPW to the fuel injector drivers 54 of FIG. 1 for timed application to a next active engine cylinder of FIG. 1. The operations of the current iteration of the fuel control procedure of FIG. 3 are next concluded by returning, via a next step 316, to resume execution of any prior controller operations that may have been temporarily suspended to allow for execution of the operations of FIG. 3 following the cylinder top dead center event, as described.

Returning to step 306, if open-loop operations are determined to not be active, closed-loop fueling control operations are next carried out by determining, at a next step 324, a closed-loop fueling command correction through any suitable conventional closed-loop control process. For example, the EOS signal sampled at the described step 302 may be applied to update an integrator value determined through a fueling error integration process with the integrator magnitude varied so as to gradually drive any difference between actual and desired air/fuel ratio toward zero as is generally understood in the art. A fuel pulse width command is next determined at a step 326 by applying the correction determined at the step 324 to the base pulse width determined at the step 304, and then converting the resulting value to an equivalent pulse width for the injectors 38 of FIG. 1, as described at the step 312. The fueling command is next output at a step 328 as command FPW to the drivers 54 of FIG. 1 for timed application to the fuel injector of the next active engine cylinder, as is generally understood in the art.

Having completed closed-loop fueling operations, the operations of FIG. 3 turn to RVP measurement operations, by proceeding from step 328 to next determine whether the RVP test flag is set at a step 330. If the flag is determined to be set, RVP analysis operations are required. The RVP analysis operations provide for estimation of fuel RVP and include two test phases. A first test phase determines a representative closed-loop fuel injection pulse width with the purge valve 22 of FIG. 1 in a fully restricted state in which substantially no vapor is allowed to pass from the carbon canister 40 (FIG. 1) to the manifold 18. A second test phase determines a -representative closed-loop fuel injection pulse width with the purge valve 22 of FIG. 1 in a substantially unrestricted state. In this embodiment, signal PPW of FIG. 1, which is applied to the purge valve 22 of FIG. 1, is set at approximately twenty to thirty percent duty cycle to drive the purge valve 22 to the state of the second test phase in which fuel vapor may pass substantially unrestricted from the carbon canister 40 to the manifold 18.

Returning to FIG. 3, if the RVP test flag is determined to be set at the step 330, a determination is made at a next step 331 as to whether steady state operating conditions are currently present characterized by a substantially steady engine load and fueling requirement, such as under idle or cruise conditions. If steady state conditions are not present as determined at the step 331, the analysis is temporarily suspended and the operations of FIG. 3 concluded by proceeding to the described step 316. If steady state operating conditions are determined to be present at the step 331, the analysis continues by determining the current active test phase at a next step 332. If the first phase (the purge off phase) is active, steps 334–342 are executed and if the second phase (the purge on phase) is active, steps 348–352 are executed. More specifically, if the first phase is active with the purge valve maintained in a closed position as provided at the described step 208 of FIG. 2, the current closed-loop pulse width PWcl, as determined at the described step 326, is added to a value SUM1, which is initialized to zero at the step 210 of FIG. 2. A counter value COUNT1 for recording the number of pulse width values included in SUM1 is next incremented at a step 338 and is then compared to a static value ENDCOUNT, set to approximately forty in this embodiment. If COUNT1 exceeds ENDCOUNT, a sufficient number of pulse width values are included in the sum SUM1 for the analysis of this embodiment, and the first phase is concluded and the second phase initiated at a next step 342. Additionally, the purge valve 22 of FIG. 1 is commanded to a test position at the step 342, such as the substantially zero restriction position corresponding to signal PPW of FIG. 1 at approximately twenty to thirty percent duty cycle, as described for the second test phase, and is maintained in such test position for the duration of the second test phase. Following the step 342, or if COUNT1 was determined to not exceed ENDCOUNT at the step 340, then the current iteration of the operations of FIG. 3 are concluded by proceeding to the described step 316.

Returning to step 332, if the current test phase is the second phase (the purge on phase) a step 38 is first executed to add the current value of PWcl as determined at the step 326, to a value SUM2, which is initialized to zero at the described step 210 of FIG. 2. A counter value COUNT2 for recording the number of pulse width values included in SUM2 is next incremented at a step 350 and is then compared to the described static value ENDCOUNT. If COUNT2 exceeds ENDCOUNT, a sufficient number of pulse width values are included in the sum SUM2 to allow for the carrying out of the fuel RVP analysis of the described FIG. 2, and phase two is concluded by setting the sampling complete flag at a next step 354. The sampling complete flag is initialized to zero at the described step 210 of FIG. 2. Following the step 354, or if COUNT2 was determined to not exceed ENDCOUNT at the step 352, then the current iteration of the operations of FIG. 3 are concluded by proceeding to the described step 316.

The inventor intends that the requirement of steady state operating conditions of this above embodiment may be removed through a more detailed analysis of the fueling command in accordance with an alternative embodiment of this invention and through the exercise of ordinary skill in the art. For example, conventionally-known purge learn memory factors that may be used for closed-loop fueling control may be analyzed and the change in fueling required between the first and second test phases of FIG. 3 derived directly therefrom for application at step 232 of FIG. 2 to determine ΔPW.

The inventor further intends that fuel RVP may further be estimated in accordance with this invention through direct analysis of fuel vapors generated and resident within the fuel supply 34, such as in the headspace of a conventional fuel tank. More specifically, a conventional binary solenoid valve may be disposed within the conduit 56 of FIG. 1 and may be driven, during the above-described first and second test phases, to a closed position to ensure that fuel vapors are drawn from the fuel supply 34. The remaining procedures of FIGS. 2 and 3 of the preferred embodiment would be preserved in such alternative embodiment. Accurate RVP estimation is thereby provided without a requirement of purging the carbon canister 40 (FIG. 1).

In yet a further alternative embodiment, a conductive foam fuel vapor sensor, such as that described in U.S. Pat. No. 5,560,347, assigned to the assignee of this invention and hereby incorporated herein by reference, may be included in the carbon canister 40 with a pair of electrodes for detecting fuel reid vapor pressure. An electrical potential is applied across the pair of electrodes, with the level of electrical current induced therebetween indicating the hydrocarbon (HC) concentration of the fuel vapor trapped in the canister, as disclosed in the incorporated reference. The HC concentration, at a known temperature, may be used to indicate fuel RVP, for example through application of signal Tf of FIG. 1, and a signal indicating the induced current between the electrodes of the incorporated reference, to a calibrated lookup table in a read only memory device of controller 50 of FIG. 1, to retrieve an RVP value indicating the volatility of the trapped fuel for application in fueling control and diagnostic in accordance with this invention, for example in the manner described in FIGS. 2 and 3 of the preferred embodiment.

The preferred embodiment is not intended to limit or restrict the invention since many modifications may be made through the exercise of ordinary skill in the art without departing from the scope of the invention.

The embodiments of the invention in which a property or privilege is claimed are described as follows.

What is claimed is:

1. A method for estimating automotive internal combustion engine fuel volatility in an internal combustion engine selectively receiving fuel vapors trapped in a fuel vapor recovery system, comprising the steps of:

admitting fuel vapors from the fuel vapor recovery system to the engine for combustion therein;

determining a change in engine fueling resulting from the admission of fuel vapors from the fuel vapor control system to the engine; and estimating fuel volatility as a function of the determined change.

2. The method of claim 1, further comprising the step of:

estimating fuel temperature; and wherein the step of estimating fuel volatility estimates fuel volatility as a function of the determined change and of the estimated fuel temperature.

3. The method of claim 1, further comprising the steps of:

providing a desired engine fueling rate;

estimating actual engine fueling rate; and generating a correction value for correcting the engine fueling rate in direction to drive the actual engine fueling rate toward the desired fueling rate; and wherein the determining step determines the change in engine fueling as a function of the change in the correction value resulting from the admission of fuel vapors from the fuel vapor control system to the engine.

4. The method of claim 1, wherein the determining step further comprises the steps of:

generating, while admitting the fuel vapors from the fuel vapor recovery system to the engine, a first closed-loop fueling command for maintaining an engine air/fuel ratio substantially at a target air/fuel ratio;

generating, while not admitting the fuel vapor from the fuel vapor recovery system to the engine, a second closed-loop fueling command for maintaining the engine air/fuel ratio at the target air/fuel ratio; and determining the change in engine fueling as a difference between the first and the second closed-loop fueling command.

5. The method of claim 1, further for controlling engine fueling under open-loop operating conditions, further comprising the steps of:

identifying when open-loop operating conditions are present; and while open-loop operating conditions are identified as present, (a) referencing an open-loop fueling command, (b) generating a fueling correction factor as a function of the estimated fuel volatility, (c) applying the fueling correction factor to the open-loop fueling command to correct the open-loop fueling command, and (d) controlling engine fueling in accordance with the corrected open-loop fueling command.

6. The method of claim 1, further for diagnosing fault conditions in the fuel vapor recovery system through application of a diagnostic procedure sensitive to fuel volatility, the method further comprising the steps of:

diagnosing fault conditions in the fuel vapor recovery system;

establishing a fuel volatility range under which the accuracy of the diagnostic procedure is reduced;

comparing the estimated fuel volatility to the established fuel volatility range; and indicating a reduced accuracy condition of the diagnostic procedure if the estimated fuel volatility is within the established fuel volatility range.

7. A method for controlling internal combustion engine fueling in response to estimated fuel reid vapor pressure (RVP), comprising the steps of:

trapping fuel vapors in an on-board re-fueling vapor recovery (ORVR) system;

generating a closed-loop engine fueling command;

releasing the trapped fuel vapors from the ORVR system for consumption in the engine;

determining a change in the closed-loop engine fueling command resulting from the release of the trapped fuel vapors;

estimating fuel RVP as a function of the determined change; and controlling fueling in response to the estimated fuel RVP.

8. The method of claim 7, wherein the controlling step comprises the steps of:

identifying a presence of open-loop fueling conditions; and while open-loop fueling conditions are present, (a) generating an open-loop fueling command as a function of the estimated fuel RVP, and (b) controlling engine fueling in accordance with the open-loop fueling command.

9. The method of claim 8, wherein the step of generating an open-loop fueling command comprises the steps of:

generating a base open-loop fueling command;

calculating a correction factor as a function of the estimated fuel RVP; and applying the correction factor to the base open-loop fueling command to correct the base open-loop fueling command for fuel RVP;

and wherein the controlling step controls engine fueling in accordance with the corrected base open-loop fueling command.

10. The method of claim 7, further comprising the steps of:

generating a first fueling command while fuel vapors are retained within the ORVR system;

generating a second fueling command while fuel vapors are released from the ORVR system for consumption in the engine; and calculating a difference between the first and the second fueling commands; and wherein the step of determining the change determines the change as a predetermined function of the calculated difference.

11. The method of claim 7, further comprising the step of sampling a signal indicating fuel temperature, and wherein the step of estimating fuel RVP estimates fuel RVP as a function of the determined change and of fuel temperature.

12. The method of claim 7, the method further for diagnosing ORVR system fault conditions, further comprising the steps of:

identifing a fuel RVP threshold above which fuel volatility leads to a significantly reduced ORVR system fault condition diagnostic accuracy;

diagnosing a fault condition in the ORVR system;

comparing the estimated fuel RVP to the identified fuel RVP threshold upon diagnosing an ORVR system fault condition; and indicating that the diagnosed fault condition corresponds to a reduced accuracy diagnosis when the estimated fuel RVP exceeds the identified fuel RVP threshold.

* * * * *